US007522037B2

(12) United States Patent
Ovchinnikov

(10) Patent No.: US 7,522,037 B2
(45) Date of Patent: Apr. 21, 2009

(54) METHOD FOR FORMING AND TRANSMITTING SIGNALS

(76) Inventor: Valery Vasilievich Ovchinnikov, ul. Generala Belova, 45-3-373, Moscow 125583 (RU)

( * ) Notice: Subject to any disclaimer, the term of this patent is extended or adjusted under 35 U.S.C. 154(b) by 84 days.

(21) Appl. No.: 10/530,245

(22) PCT Filed: Mar. 5, 2003

(86) PCT No.: PCT/RU03/00080

§ 371 (c)(1),
(2), (4) Date: Jan. 12, 2006

(87) PCT Pub. No.: WO2004/034348

PCT Pub. Date: Apr. 22, 2004

(65) Prior Publication Data

US 2006/0145835 A1 Jul. 6, 2006

(30) Foreign Application Priority Data

Oct. 4, 2002 (RU) ..... 2002126389
Nov. 28, 2002 (RU) ..... 2002132038

(51) Int. Cl.
*G08B 1/08* (2006.01)

(52) U.S. Cl. ..... 340/539.1; 340/506; 340/539.14; 340/628; 340/577; 347/E15.001; 347/179; 347/1; 327/512; 327/338; 327/538; 370/310

(58) Field of Classification Search ..... 340/539.1, 340/506, 539.14, 539.16, 628, 629, 630, 340/635, 577, 578; 327/512, 338, 538; 374/1, 374/179, E15.001; 370/310
See application file for complete search history.

(56) References Cited

U.S. PATENT DOCUMENTS 4,543,565 A * 9/1985 Oberstein et al. ..... 340/506

FOREIGN PATENT DOCUMENTS

| | | |
|---|---|---|
| EP | 0 122 432 | 10/1984 |
| RU | 2173887 | 9/2001 |
| SU | 551675 | 3/1977 |
| SU | 855703 | 8/1981 |
| SU | 1390622 | 4/1988 |

* cited by examiner

*Primary Examiner*—Jeffery Hofsass
*Assistant Examiner*—Sisay Yacob
(74) *Attorney, Agent, or Firm*—Ladas and Parry LLP

(57) ABSTRACT

The present invention relates to automatic fire alarm signaling, and more particularly to the activation of fire alarm signaling by an analysis of a monitored fire factor (smoke level, temperature, etc.) and makes it possible to reduce the cost of the signal transmission process, as well as to provide compatibility of the fire alarm unit with inexpensive receiving-monitoring instruments having analog signaling loops. The essence of the method of the invention consists in processing digital information directly in the alarm unit and in transmitting the results of sophisticated digital processing of information to the receiving-monitoring instrument with the aid of simple analog signals.

9 Claims, No Drawings

METHOD FOR FORMING AND TRANSMITTING SIGNALS

FIELD OF THE ART

The present invention relates to automatic fire alarm signaling, and more particularly to the activation of fire alarm signaling by an analysis of a monitored fire factor (smoke level, temperature, etc.).

BACKGROUND OF THE INVENTION

Known in the art is a method of forming a signal in a fire alarm unit, connected with its output to a communication line with a receiving-monitoring instrument, which comprises a monitored fire factor detector and a transmitting device connected to the output of the alarm unit, said method consisting in detecting an excess of the threshold value of the monitored fire factor, generating an alarm signal and transmitting this alarm signal to the communication line with the aid of a transmitting device (IVS-Signalspetsavtomatika products catalogue, Obninsk, 2000, page 2 "IP212-44 (DIP-44) Optical-electronic fire smoke alarm unit").

The known method of transmitting information is simple to implement, but it lacks testing of the operability of the alarm unit components and of the dust content of the optical chamber, thereby the operational reliability of the method being lowered.

Closest in the technical essence and attainable result to the present method is a method of forming and transmitting signals from a fire alarm unit to a receiving-monitoring instrument via a communication line with the aid of a transmitting device which forms part of the alarm unit, which method comprises self-testing of the operability of the alarm unit components and measuring the value of a monitored fire factor (www.systemsensor.ru). The formation and transmission of the value of the monitored fire factor and of the failure information via the communication line are performed in a digital code with the aid of a receiving-transmitting device.

The disadvantages of the known method of forming a signal in a fire alarm unit are as follows: high prime cost of the process due to the use of an expensive alarm unit and an expensive receiving-monitoring instrument, which comprise devices for digital exchange of information, as well as low reliability and noise immunity of the digital link of the instrument with the alarm unit, and limitations as to the compatibility of instruments and alarm units (digital information exchange protocols being individual for each type of instrument and alarm unit).

DISCLOSURE OF THE INVENTION

The main object of the present invention is to reduce the cost of the process of transmitting information when generating a signal in a fire alarm unit about a failure in the alarm unit and about the value of a monitored fire factor having reached the permissible level by ensuring compatibility of the alarm unit with inexpensive receiving-monitoring instruments with analog signaling loops.

The stated object is accomplished by that in a method of forming and transmitting signals from a fire alarm unit to a receiving-monitoring instrument via a communication line with the aid of a transmitting device which is a part of the alarm unit, which method comprises self-testing of the operability of the alarm unit components and determining the value of a monitored fire factor, the alarm unit is additionally provided with a logic device, with the aid of which the value of the monitored fire factor is compared with the permissible value, while the signals about the operability of the alarm unit derived from the results of its self-testing and about the permissible value of the monitored fire factor having been exceeded are transmitted in an analog mode.

In the method of the invention the signal indicating an excess of the permissible value of the monitored fire factor is transmitted by varying and fixing the output resistance of the transmitting device.

The signal indicating correct operation or failure of the alarm unit, derived from the results of its self-testing is transmitted by short-time periodic variation of the output resistance of the transmitting device.

In the method of the invention the alarm unit is additionally provided with a normally closed switch, connected in parallel to the alarm unit, with a device limiting the voltage drop at the alarm unit to a value of 1.5-6 V, the signal indicating correct operation of the alarm unit being transmitted by opening the switch.

A voltage drop at the alarm unit of more than 6 V (but less than the threshold value for the "Fire" signal, which is determined by the type of instrument) is recognized by the receiving-monitoring instrument as a "Fire" signal, and not as a "Short circuit" signal. A voltage drop to less than 1.5 V does not allow the operability of the alarm unit components to be maintained.

The alarm unit is additionally provided with a normally open line switch, inserted into a communication line gap after the alarm unit, the communication line is provided with an end resistor, and the alarm unit failure signal is transmitted by closing the line switch.

The alarm unit is additionally provided with a normally closed line switch, inserted into a communication line gap after the alarm unit, the communication line is provided with an end resistor, and an alarm unit failure signal is supplied by opening the line switch.

The stated object is accomplished also by that in a method of forming and transmitting signals from a fire alarm unit to a receiving-monitoring instrument via a bipolar communication line with the aid of a transmitting device which is a part of the alarm unit, which method comprises self-testing of the operability of the alarm unit components and determining the value of a monitored fire factor, the alarm unit is additionally provided with a gate and a logic device, with the aid of which the value of the monitored fire factor is compared with the permissible value, and the signals about the operability of the alarm unit, derived from the results of its self-testing and about the permissible value of the monitored fire factor having been exceeded are transmitted in an analog mode.

The alarm unit is additionally provided with a normally closed switch connected in parallel to the alarm unit and with a gate connected in series therewith, it which is open under reverse polarity conditions in the communication line, and the alarm unit operability signal is transmitted by opening the switch.

Receiving-monitoring instruments with a bipolar (alternating-sign) communication line carry out power supply to alarm units in forward polarity, and failure determination (break or short circuit in the communication line) in reverse polarity. A "Failure" signal from the alarm unit in the proposed method is generated with the aid of a switch and a gate as a short circuit in reverse polarity.

The additional coupling of a gate, open under reverse polarity conditions, in series with the switch in the communication line, makes it possible to broaden the functional potentialities of the method: to preserve the operability of the line and of the alarm units installed therein during transmission of the "Failure" signal by one of the alarm units, since the power supply of the alarm units under forward polarity conditions is preserved.

The alarm unit is additionally provided with a normally open line switch inserted into a communication line gap after the alarm unit, the communication line is provided with an end resistor, a gate open under forward polarity conditions in the communication line is connected in parallel to the line switch, and an alarm unit operability signal is transmitted by closing the line switch.

In the bipolar line, a "Failure" signal from the alarm unit is recognized by the receiving-monitoring instrument as a line break, which it tests in reverse polarity. The coupling of a gate makes it possible to preserve the operability of the line and of the alarm units installed in it during transmission of the "Failure" signal by one of the alarm units, since the power supply of the alarm units forward polarity is preserved.

The essence of the method consists in processing digital information directly in the alarm unit and in transmitting the results of sophisticated digital processing of information with the aid of simple analog signals.

BEST VARIANTS OF BRINGING THE METHOD INTO EFFECT

EXAMPLE 1

For carrying the proposed method for forming and transmitting signals into effect, use is made of an alarm unit comprising a smoke (temperature) detector, devices for testing the operability of the alarm unit components, and a transmitting device connected to the output of the alarm unit, the output of the alarm unit being connected in parallel to a communication line.

The alarm unit is provided with a logic device and is connected with the aid of a communication line to a receiving-monitoring instrument.

In the alarm unit duty mode, the operability of its components is tested with the aid of an appropriate device, and when the alarm unit is found to be operating properly a "Norm" signal is generated by a short-time periodic reduction of the output resistance of the transmitting device. In the case of failure of the alarm unit, the absence of the "Norm" signal is recognized by the receiving-monitoring instrument as a "Failure" signal and is accompanied by the output of an appropriate message.

In the properly operating alarm unit (as judged from the results of self-testing), the smoke level (temperature) value is determined by the detector. With the aid of the logic device, the detected smoke level (temperature) value is compared with the permissible value, and when the latter is exceeded, a "Fire" signal is transmitted to the communication line by reducing and fixing the output resistance of the transmitting device.

EXAMPLE 2

An alarm unit, comprising a smoke (temperature) detector, devices for testing the operability of the alarm unit components, and a transmitting device connected to the output of the alarm unit, the output of the alarm unit being connected in parallel to a communication line, is used for implementation of the proposed method of forming and transmitting signals.

The alarm unit is provided with a normally closed switch connected in parallel to the alarm unit, and with a device limiting the voltage drop at the alarm unit to of 5 V (a 5 V Zener breakdown diode connected in series with the switch, serves as such device in this Example of implementing the method), and also with a logic device, and is coupled to a receiving-monitoring instrument with the aid of a communication line.

In the alarm unit duty mode, the operability of its components is tested with the aid of an appropriate device, and when the alarm unit is found to be operating properly a "Norm" signal is generated by opening the switch. Upon failure of the alarm unit, the switch is closed and the voltage drop at the alarm unit is limited to 5 V, which is recognized by the receiving-monitoring instrument as a "Failure" signal (short circuit of the line) and is accompanied by the output of an appropriate message.

In the properly operating alarm unit (as judged from the results of self-testing), the smoke level (temperature) value is determined by the detector. With the aid of the logic device, the detected smoke level (temperature) value is compared with the permissible value, and when the latter is exceeded, a "Fire" signal is transmitted to the communication line by reducing and fixing the output resistance of the transmitting device.

EXAMPLE 3

An alarm unit comprising a smoke (temperature) detector, devices for testing the operability of the alarm unit components, and a transmitting device connected to the output of the alarm unit, the output of the alarm unit being connected in parallel to a communication line, is used for the implementation of the proposed method of forming and transmitting signals.

The alarm unit is provided with a normally open line switch inserted into a communication line gap after the alarm unit (i.e. on the other side relative to the receiving-monitoring instrument), and also with a logic device, and the communication line is provided with an end resistor and is coupled to the receiving-monitoring instrument.

In the alarm unit duty mode, the operability of its components is tested with the aid of an appropriate device, and when the alarm unit is found to be operating properly, a "Norm" signal is generated by closing the switch. Upon failure of the alarm, the switch is opened, and this is recognized by the receiving-monitoring instrument as a failure (communication line break) and accompanied by the output of an appropriate message.

In the properly operating alarm unit (as judged from the results of self-testing), the smoke level (temperature) value is determined by the detector. The detected value is compared with the aid of the logic device with the permissible value, and when the latter is exceeded, a "Fire" signal is transmitted to the communication line by reducing and fixing the output resistance of the transmitting device.

EXAMPLE 4

An alarm unit comprising a smoke (temperature) detector, devices for testing the operability of the alarm unit components, and a transmitting device coupled to the output of the alarm unit, the output of the alarm unit being connected in parallel to a communication line, is used for the implementation of the proposed method of forming and transmitting signals.

The alarm unit is provided with a normally closed line switch inserted into a communication line gap after the alarm unit (i.e. on the other side relative to the receiving-monitoring instrument), and also with a logic device, and the communication line is provided with an end resistor and coupled to the receiving-monitoring instrument.

In the alarm unit duty mode, the operability of its components is tested with the aid of an appropriate device, and upon failure of the alarm unit a "Failure" signal is generated by opening the switch (this being recognized by the receiving-monitoring instrument as a communication line break).

In the properly operating alarm unit (as judged from the results of self-testing), the smoke level (temperature) value is determined by the detector. The detected value is compared with the aid of the logic device with the permissible value, and when the latter is exceeded, a "Fire" signal is transmitted to the communication line by reducing and fixing the output resistance of the transmitting device.

EXAMPLE 5

An alarm unit comprising a smoke (temperature) detector, devices for testing the operability of the alarm unit components, and a transmitting device coupled to the output of the alarm unit, the output of the alarm unit being connected in parallel to the communication line, is used for the implementation of the proposed method of forming and transmitting signals in a bipolar communication line.

The alarm unit is provided with a normally closed switch connected in parallel to the alarm unit, and with a gate connected in series therewith, which gate is open under reverse polarity conditions in the communication line, and connected to a receiving-monitoring instrument with the aid of the communication line.

In the alarm unit duty mode, the operability of its components is tested with the aid of an appropriate device, and when the alarm unit is found to be operating properly, a "Norm" signal is generated by opening the switch. Upon failure of the alarm unit, the switch is closed, and this is recognized by the receiving-monitoring instrument as a "Failure" signal (short circuit of the line under reverse polarity conditions) and accompanied by the output of an appropriate message.

As a result, in a line in which several alarm units are installed, short-circuiting of the line closure by a faulty alarm unit occurs only under reverse polarity conditions owing to the presence of the gate and does not lead to disconnection of the power supply of other alarm units in the line. In this case the alarm units preserve their operability and capability of transmitting a "Fire" signal to the receiving-monitoring instrument.

In the properly operating alarm unit (as judged from the results of self-testing), the smoke level (temperature) value is determined by a detector, compared with the aid of the logic device with the permissible value, and when the latter is exceeded, a "Fire" signal is transmitted to the communication line by reducing and fixing the output resistance of the transmitting device.

EXAMPLE 6

An alarm unit, comprising a smoke (temperature) detector, devices for testing the operability of the alarm unit components, and a transmitting device coupled to the output of the alarm unit, the output of the alarm unit being connected in parallel to the communication line, is used for the implementation of the proposed method of forming and transmitting a signal in a bipolar communication line.

The alarm unit is provided with a normally open line switch inserted into a communication line gap after the alarm unit (i.e. on the other side relative to the receiving-monitoring instrument), and also with a logic device, a gate under forward polarity conditions in the communication line, connected in parallel to the switch, and the communication line is provided with an end resistor and connected to a receiving-monitoring instrument.

The coupling of a gate makes it possible to broaden the functional potentialities of the method: in a communication line in which several alarm units are installed, opening of the line on transmission of a "Failure" signal by one alarm unit occurs only under reverse polarity conditions and does not lead to disconnection of the power supply of other alarm units in the line. In this case, the alarm units preserve their operability and capability of transmitting a "Fire" signal to the receiving-monitoring instrument.

In the alarm unit duty mode, the operability of its components is tested with the aid of an appropriate device, and when the alarm unit is found to be operating properly, a "Norm" signal is generated by closing the switch. Upon failure of the alarm unit, the switch is opened, and this is recognized by the receiving-monitoring instrument as a "Failure" signal (communication line break in reverse polarity) and accompanied by the output of an appropriate message.

In the properly operating alarm unit (as judged from the results of self-testing), the smoke level (temperature) value is determined by the detector. With the aid of the logic device, the smoke level (temperature) value is determined by a detector. The detected value is compared by means of the logic device with the permissible value, and when the latter is exceeded, a "Fire" signal is transmitted to the communication line by reducing and fixing the output resistance of the transmitting device.

INDUSTRIAL APPLICABILITY

The proposed method of forming and transmitting signals can be widely used in automatic fire alarm signaling, wherein it provides a reduction in the cost of the fire alarm unit and ensures its compatibility with inexpensive receiving-monitoring instruments having analog signaling loops, since the alarm unit transmits "Fire" and "Failure" ("Norm") signals by a method which can be recognized by a conventional receiving-monitoring instrument, simulating conventional "Fire" and "Failure" signals in an analog signaling loop.

The invention claimed is:

1. In a method of forming and transmitting signals from a fire alarm unit to a receiving-monitoring instrument via a communication line with the aid of a transmitting device which is a part of the fire alarm unit, the method comprising self-testing operability of the fire alarm unit and determining a value of a monitored fire factor, the improvements characterized in that the fire alarm unit is additionally provided with a logic device for comparing the value of the monitored fire factor with a permissible value, and the signals including (1) a first signal indicating the operability of the fire alarm unit as judged from the self-testing and (2) a second signal indicating that the permissible value of the monitored fire factor has been exceeded are transmitted in an analog mode such that simultaneous transmission of the first and second analog signals carrying different information is performed via the same communication line.

2. The method as claimed in claim 1, in which the signal indicating that the permissible value of the monitored fire factor has been exceeded is transmitted by varying and fixing the output resistance of the transmitting device.

3. The method as claimed in claim 1, in which the signal indicating correct operation or failure of the alarm unit as judged from the results of its self-testing is transmitted by short-time periodic variation of the output resistance of the transmitting device.

4. The method as claimed in claim 1, in which the alarm unit is additionally provided with a normally closed switch, connected in parallel to the alarm unit with a device limiting the voltage drop at the alarm unit to a value of 1.5-6 V, the signal indicating correct operation of the alarm unit being transmitted by opening the switch.

5. The method as claimed in claim 1, in which the alarm unit is additionally provided with a normally open line switch inserted into a communication line gap after the alarm unit, the communication line is provided with an end resistor, and the signal indicating failure of the alarm unit is transmitted by closing the line switch.

6. The method as claimed in claim 1, in which the alarm unit is additionally provided with a normally closed line switch inserted into a communication line gap after the alarm unit, the communication line is provided with an end resistor, and the signal indicating failure of the alarm unit is transmitted by opening the line switch.

7. A method of forming and transmitting signals from a fire alarm unit to a receiving-monitoring instrument via a bipolar communication line with the aid of a transmitting device which is a part of the alarm unit, the method comprising self-testing of the operability of the alarm unit components and determining the value of a monitored fire factor, in which the alarm unit is additionally provided with a gate and a logic device, with the aid of which the value of the monitored fire factor is compared with the permissible value, and the signals including (1) a first signal indicating the operability of the alarm unit as judged from the results of its self-testing and (2) a second signal indicating that the permissible value of the monitored fire factor has been exceeded are transmitted in an analog mode such that simultaneous transmission of the first and second analog signals carrying different information is performed via the same communication line.

8. The method as claimed in claim 7, in which the alarm unit is additionally provided with a normally closed switch, connected in parallel to the alarm unit and with a gate connected in series with it which is open under reverse polarity conditions in the communication line, and the alarm unit operability signal is transmitted by opening the switch.

9. The method as claimed in claim 7, in which the alarm unit is additionally provided with a normally open line switch inserted into a communication line gap after the alarm unit, the communication line is provided with an end resistor, a gate, open under forward polarity conditions in the communication line, is connected in parallel to the line switch, and the alarm unit operability signal is transmitted by closing the line switch.

* * * * *

UNITED STATES PATENT AND TRADEMARK OFFICE

CERTIFICATE OF CORRECTION

PATENT NO. : 7,522,037 B2
APPLICATION NO. : 10/530245
DATED : April 21, 2009
INVENTOR(S) : Valery Vasilievich Ovchinnikov It is certified that error appears in the above-identified patent and that said Letters Patent is hereby corrected as shown below:

Title page, item (30), "Oct. 4, 2002" should read -- Oct. 10, 2002 --

Signed and Sealed this

Eighth Day of September, 2009

David J. Kappos

David J. Kappos
*Director of the United States Patent and Trademark Office*